US008449753B2

(12) United States Patent
Muramatsu et al.

(10) Patent No.: US 8,449,753 B2
(45) Date of Patent: May 28, 2013

(54) PLATING PRETREATMENT APPARATUS AND METHOD FOR CYLINDER BLOCK

(75) Inventors: Hitoshi Muramatsu, Hamamatsu (JP); Seiya Kunioka, Hamamatsu (JP); Nobuyuki Suzuki, Toyohashi (JP); Naoyuki Suda, Hamamatsu (JP); Akira Ishibashi, Hamamatsu (JP); Tomohiro Asou, Hamamatsu (JP); Minoru Imai, Iwata (JP); Manabu Suzuki, Hamamatsu (JP); Masahiro Ogawa, Hamamatsu (JP)

(73) Assignee: Suzuki Motor Corporation, Hamamatsu-shi, Shizuoka-Ken (JP)

( * ) Notice: Subject to any disclaimer, the term of this patent is extended or adjusted under 35 U.S.C. 154(b) by 717 days.

(21) Appl. No.: 12/568,386

(22) Filed: Sep. 28, 2009

(65) Prior Publication Data

US 2010/0078326 A1 Apr. 1, 2010

(30) Foreign Application Priority Data

Sep. 30, 2008 (JP) ..... 2008-254076

(51) Int. Cl.
*C25D 5/34* (2006.01)
*C25F 3/00* (2006.01)
*C25F 7/00* (2006.01)

(52) U.S. Cl.
USPC ..... 205/219; 205/205; 205/210; 205/660; 205/704; 205/705

(58) Field of Classification Search
USPC ..... 204/237, 260; 118/317
See application file for complete search history.

(56) References Cited

U.S. PATENT DOCUMENTS

| | | | | |
|---|---|---|---|---|
| 5,682,676 | A * | 11/1997 | Ikegaya | 29/888.06 |
| 6,383,348 | B2 * | 5/2002 | Kuroda et al. | 204/237 |
| 2008/0047829 | A1 * | 2/2008 | Ogawa et al. | 204/275.1 |

FOREIGN PATENT DOCUMENTS

| | | | |
|---|---|---|---|
| JP | 07-118891 | | 5/1995 |
| JP | 08-144082 | | 6/1996 |
| JP | 09-13193 | | 1/1997 |
| JP | 2000-192284 | | 7/2000 |
| JP | 2000-192285 | | 7/2000 |
| JP | 2000-192286 | | 7/2000 |
| JP | 2001-200391 | | 7/2001 |
| JP | 2006-002204 | * | 5/2006 |

* cited by examiner

*Primary Examiner* — Luan Van
*Assistant Examiner* — Ho-Sung Chung
(74) *Attorney, Agent, or Firm* — Barnes & Thornburg LLP

(57) ABSTRACT

The present invention provides an apparatus for plating pretreatment of a cylinder block that includes an electrode performing a plating pretreatment of the cylinder inner wall surface. A gap flow channel communicates with an in-electrode flow channel at a position closest to a seal jig, the gap flow channel being adapted to introduce a treatment liquid to the cylinder inner wall surface, the in-electrode flow channel being adapted to receive the treatment liquid having passed through a communicating hole. The present invention is provided a method for pretreating before plating a cylinder block including disposing an electrode to face the cylinder inner wall surface so as to form a gap flow channel, and introducing a treatment liquid to the gap flow channel thereby flowing through the treatment liquid toward a seal jig and then into an in-electrode flow channel through a communicating hole.

5 Claims, 10 Drawing Sheets

The adhesion of plating film for different flow rates of the treatment liquid in the electrolytic etching

| | 5cm/second | 10cm/second | 20cm/second | 30cm/second | 40cm/second | 50cm/second |
|---|---|---|---|---|---|---|
| aposition close to the crank case surface | × | △ | ○ | ◎ | ◎ | ◎ |
| aposition close to the head surface | △ | ○ | ◎ | ◎ | ◎ | ◎ |
| an intermediate position | ◎ | ◎ | ◎ | ◎ | ◎ | ◎ |

◎:best
○:good
△:pass
×:out

FIG. 11

PLATING PRETREATMENT APPARATUS AND METHOD FOR CYLINDER BLOCK

CROSS-REFERENCE TO RELATED APPLICATION(S)

This United States Non-Provisional Utility patent application claims priority to and relies for priority upon Japanese Patent Application No. 2008-254076, which was filed on Sep. 30, 2008, the contents of which are incorporated herein by reference.

BACKGROUND OF THE INVENTION

1. Field of the Invention

The present invention relates to plating pretreatment apparatus and method for a cylinder block that perform a plating pretreatment of a cylinder inner wall surface of a cylinder in a cylinder block by sealing one end of the cylinder inner wall surface and circulating a treatment liquid.

2. Description of the Related Art

There are many cylinder block manufacturing methods that involve coating the cylinder inner wall surface with a plating film.

For example, as shown in FIG. 1, the technique according to Patent Document 1 (Japanese Patent Laid-Open No. 9-13193) includes a plating pretreatment step in which a required amount of treatment liquid is supplied to a cylinder inner wall surface 102 of a cylinder 101 in a cylinder block 100 by means of a pump 103, and then the pump 103 is stopped and valves 104 and 105 are closed to retain the treatment liquid in the cylinder 101 for a predetermined time, thereby performing a plating pretreatment. In the following plating step, one end of the cylinder inner wall surface 102 is sealed with a seal jig (not shown in FIG. 1), and then a plating solution is supplied into and circulated in the cylinder 101 by means of the pump 103 to perform a plating treatment.

Furthermore, as shown in FIG. 2, the techniques disclosed in Patent Documents 2 and 3 (Japanese Patent Laid-Open Nos. 2000-192284 and 2000-192285) include a plating pretreatment step in which one end of the cylinder inner wall surface 102 of the cylinder block 100 is sealed with a seal jig 106, a treatment liquid is introduced to the cylinder inner wall surface 102, and a voltage is applied between an electrode 107 and the cylinder block 100 to perform a plating pretreatment.

However, in the plating pretreatment described in Patent Document 1, reaction gas produced in the plating pretreatment flows outside the cylinder block 100 because one end of the cylinder inner wall surface 102 is open. If the reaction gas is a toxic gas, it may corrode the equipment or adversely affect the health of operators.

In the plating pretreatments described in Patent Documents 2 and 3, reaction gas 108 produced in the plating pretreatment may be accumulated in the vicinity of the cylinder inner wall surface 102 of the cylinder 101 to compromise electrical conduction or hinder filling with the treatment liquid, and the plating pretreatment may be inadequate.

SUMMARY OF THE INVENTION

The present invention has been devised in view of the circumstances described above, and an object of the present invention is to provide plating pretreatment apparatus and method for a cylinder block that prevent reaction gas from being discharged to the work environment and from being accumulated in a gap flow channel between a cylinder inner wall surface and an electrode to avoid a problem, such as an inadequate energization.

According to the present invention for solving the above object, there is provided an apparatus for plating pretreatment of a cylinder block includes a seal jig sealing one end of a cylinder inner wall surface of a cylinder in the cylinder block, and an electrode performing a plating pretreatment of the cylinder inner wall surface, the electrode disposed to face the cylinder inner wall surface, the electrode forming a gap flow channel between the cylinder inner wall surface and the outer surface of the electrode, the electrode having an in-electrode flow channel formed therein, the gap flow channel communicating with the in-electrode flow channel via a communicating hole formed in the gap flow channel at a position closest to the seal jig, the gap flow channel being adapted to introduce a treatment liquid to the cylinder inner wall surface and flow the treatment liquid therethrough toward the seal jig, the in-electrode flow channel being adapted to receive and flow therethrough the treatment liquid having passed through the communicating hole.

Further, the present invention is provided a method for pretreating before plating a cylinder block including sealing one end of a cylinder inner wall surface of a cylinder in the cylinder block, disposing an electrode to face the cylinder inner wall surface so as to form a gap flow channel between the cylinder inner wall surface and the outer surface of the electrode, the electrode having an in-electrode flow channel formed therein, the gap flow channel communicating with the in-electrode flow channel via a communicating hole formed in the gap flow channel at a position closest to the seal jig, and introducing a treatment liquid to the gap flow channel thereby flowing through the treatment liquid toward the seal jig and then into the in-electrode flow channel through the communicating hole.

The plating pretreatment apparatus and method for a cylinder block according to the present invention seals one end of the cylinder inner wall surface with the seal jig before, performing the plating pretreatment of the cylinder inner wall surface. Therefore, the seal jig prevents the reaction gas produced in the plating pretreatment from being discharged to the work environment and the treatment liquid from flowing to the parts other than the cylinder inner wall surface.

In addition, the treatment liquid flowing through the gap flow channel between the cylinder inner wall surface and the electrode toward the seal jig flows into the in-electrode flow channel at the uppermost position closest to the seal jig. Therefore, the reaction gas produced in the gap flow channel is discharged into the in-electrode flow channel. Therefore, accumulation of the reaction gas in the gap flow channel is prevented, and problems, such as inadequate energization, are avoided.

BRIEF DESCRIPTION OF THE DRAWINGS

FIG. 7 includes cross-sectional views of the seal jig shown in FIG. 2, in which FIG. 7 shows a state where a seal member is expanded;

FIG. 8 includes cross-sectional views of the seal jig shown in FIG. 2, in which FIG. 8 shows a state where the seal member is shrunk;

FIG. 11 is a table showing the adhesion of a plating film for different flow rates of the treatment liquid in the electrolytic etching.

DETAILED DESCRIPTION OF THE PREFERRED EMBODIMENTS

In the following, an embodiment of the present invention will be described with reference to the drawings. However, the present invention is not limited to the embodiment.

Figure 1:
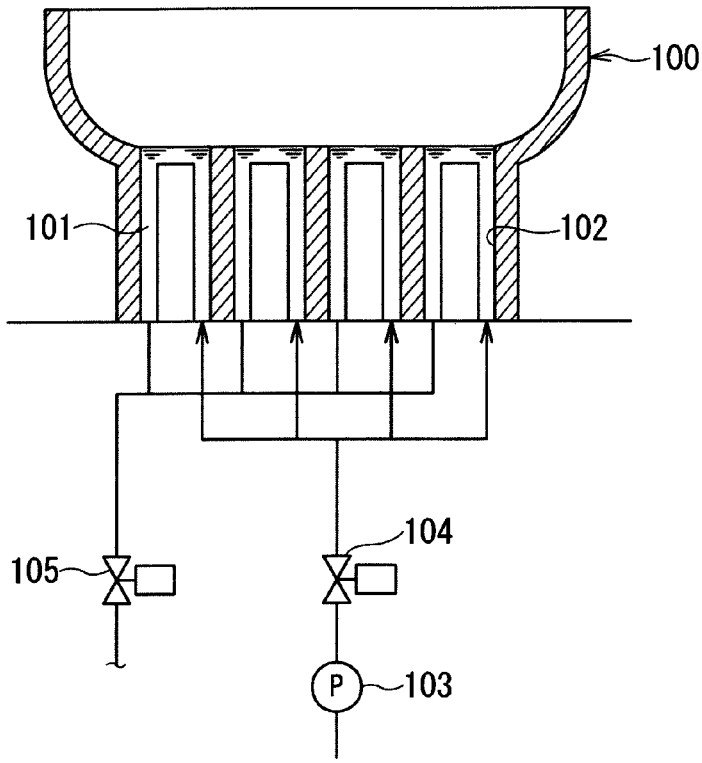
PRIOR ART FIG. 1
FIG. 1 is a diagram for illustrating a conventional plating pretreatment.
Figure 2:
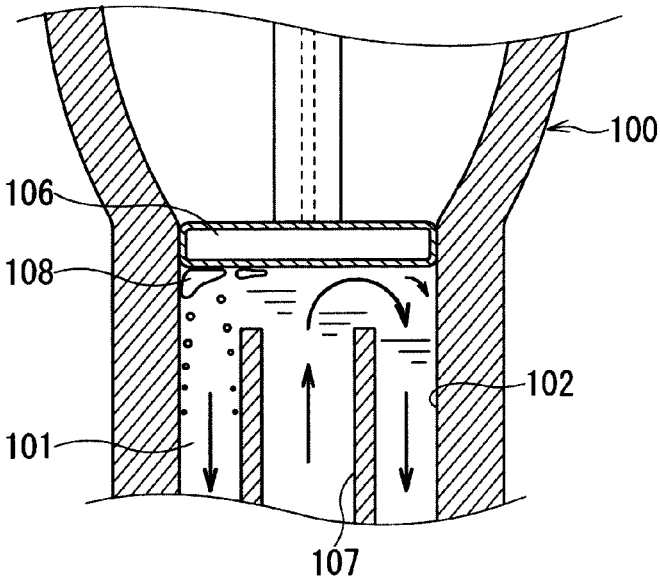
PRIOR ART FIG. 2
FIG. 2 is a diagram for illustrating another conventional plating pretreatment.
Figure 3:
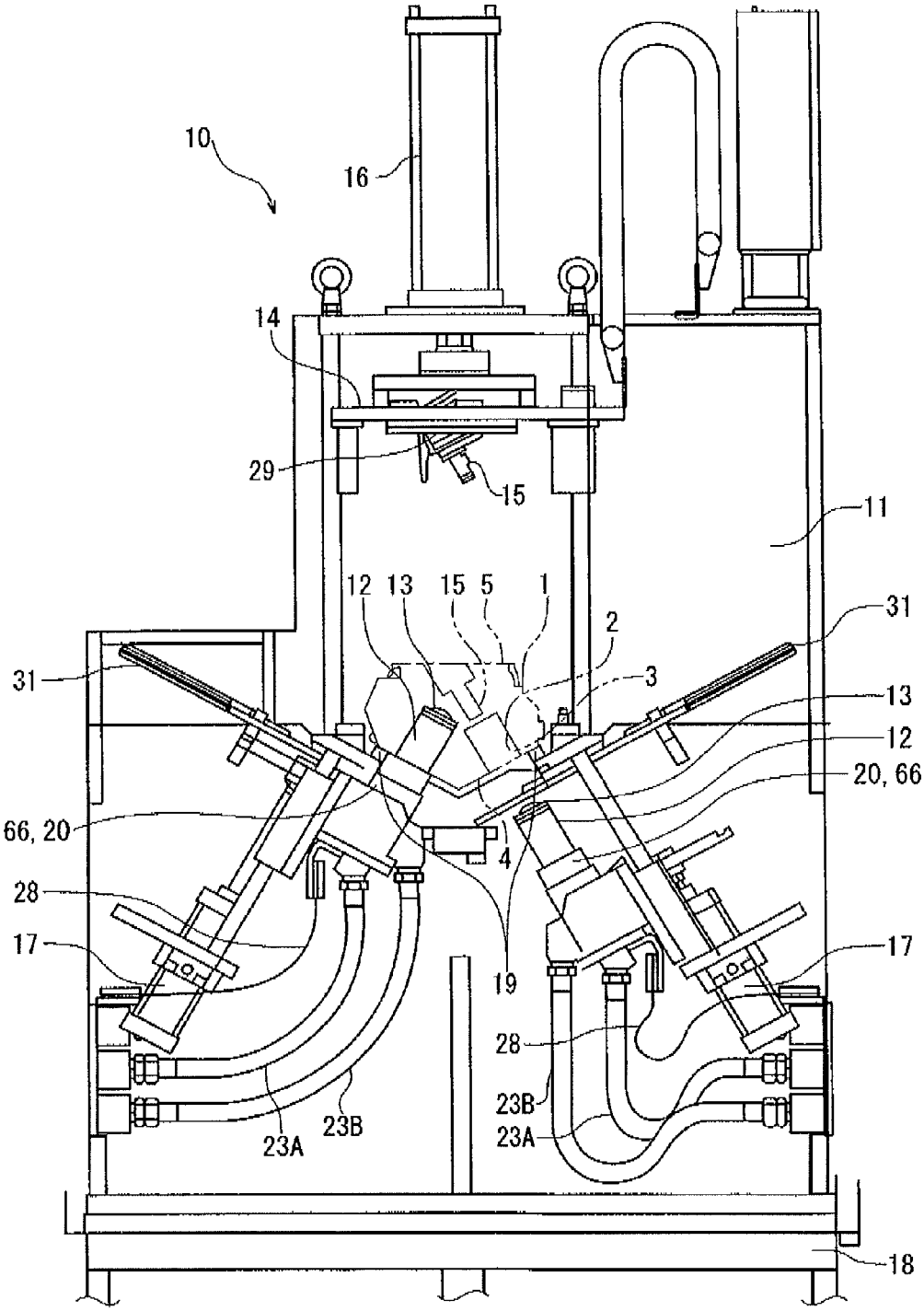
FIG. 3 is a front view of the whole of a treatment apparatus to which a plating pretreatment apparatus for a cylinder block according to an embodiment of the present invention is applied.
Figure 4:
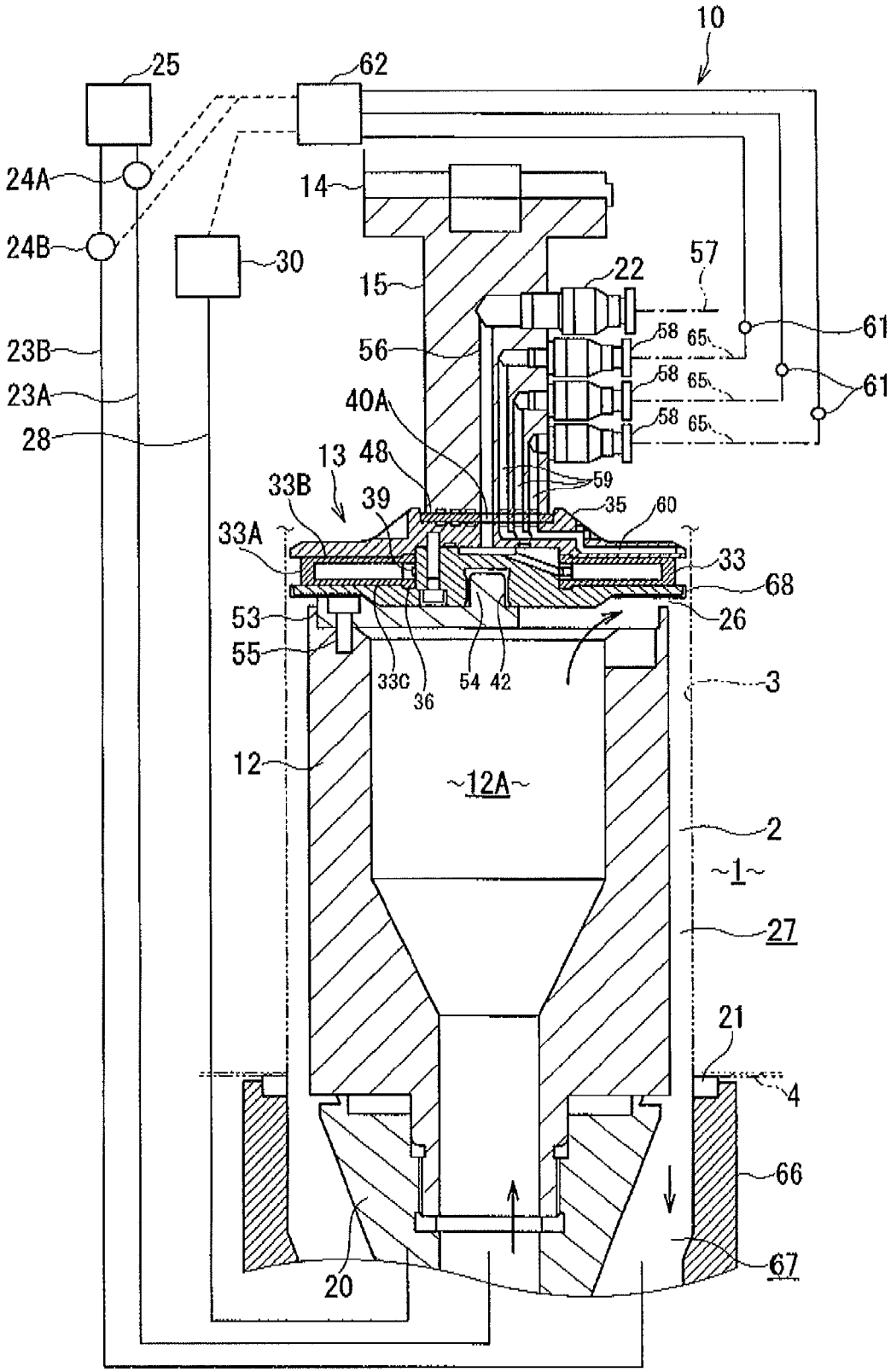
FIG. 4 is a cross-sectional view of an electrode, an air joint and their vicinity in the treatment apparatus shown in FIG. 1.

FIG. 3 is a front view of the whole of a treatment apparatus to which a plating pretreatment apparatus for a cylinder block according to an embodiment of the present invention is applied. FIG. 4 is a cross-sectional view of an electrode, an air joint and their vicinity in the treatment apparatus shown in FIG. 3.

A treatment apparatus 10 shown in FIG. 3 includes an apparatus main unit 11, an electrode 12, a seal jig 13, a workpiece holding jig 14, an air joint 15, a clamp cylinder 16 and an electrode cylinder 17. The treatment apparatus 10 seals one end of a cylinder inner wall surface 3 closer to a crank case surface 5 of a cylinder block 1 of an engine with the seal jig 13 (shown in FIG. 4), introduces a treatment liquid (a plating pretreatment liquid or a plating solution) to the cylinder inner wall surface 3, and uses the electrode 12 positioned to face the cylinder inner wall surface 3 to perform a treatment (a plating pretreatment or a plating treatment) of the cylinder inner wall surface 3 in a short time.

According to this embodiment, the cylinder block 1 is a V-type cylinder block for a V-type multi-cylinder engine. A plurality of cylinders 2 is disposed at a predetermined angle in the cylinder block 1, and the treatment apparatus 10 performs the plating pretreatment or plating treatment of the cylinder inner wall surfaces 3 of the cylinders 2 at the same time. Thus, the treatment apparatus 10 functions as a plating pretreatment apparatus for a cylinder block 1, such as an electrolytic etching apparatus and an anodizing apparatus for the cylinder block 1, and/or a plating apparatus for a cylinder block 1.

Figure 5:
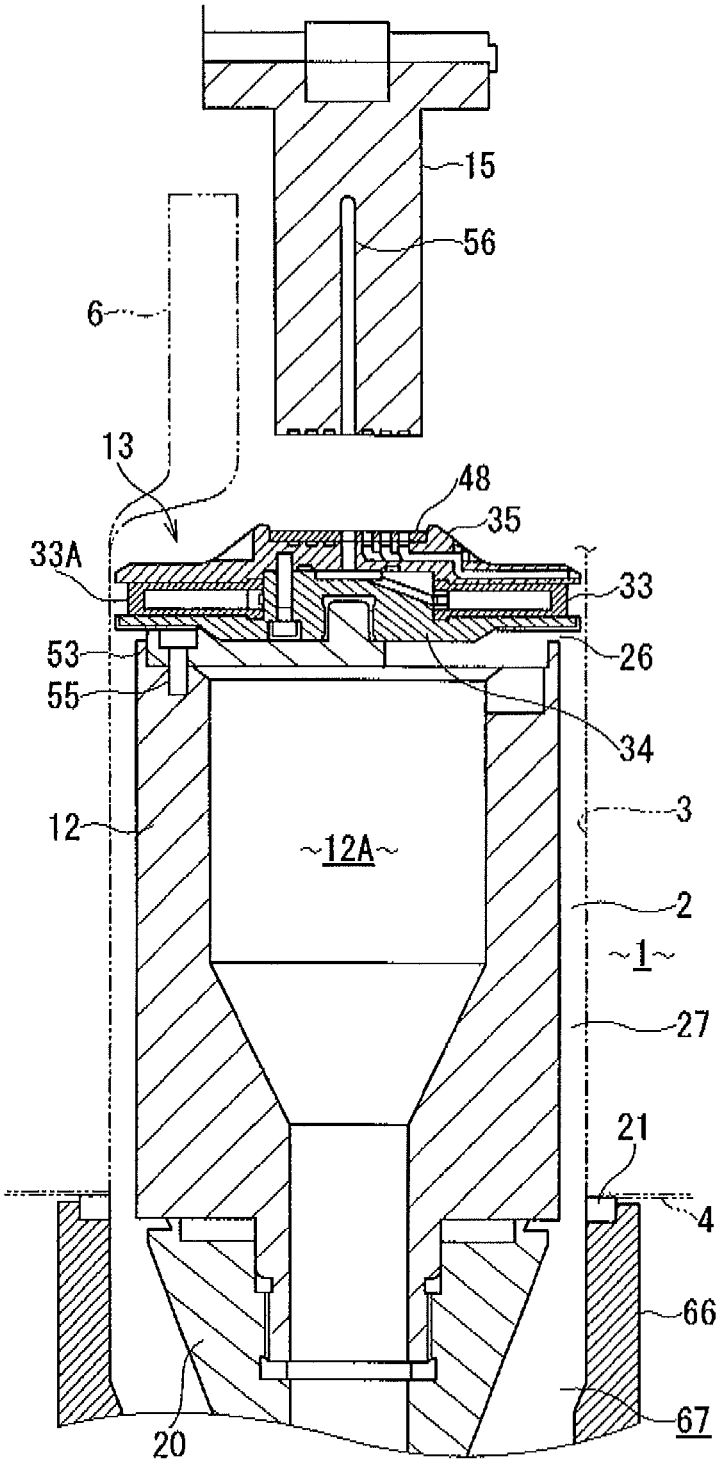
FIG. 5 is a cross-sectional view of the air joint shown in FIG. 4 and a seal jig separated from each other (in a waiting state)
Figure 6:
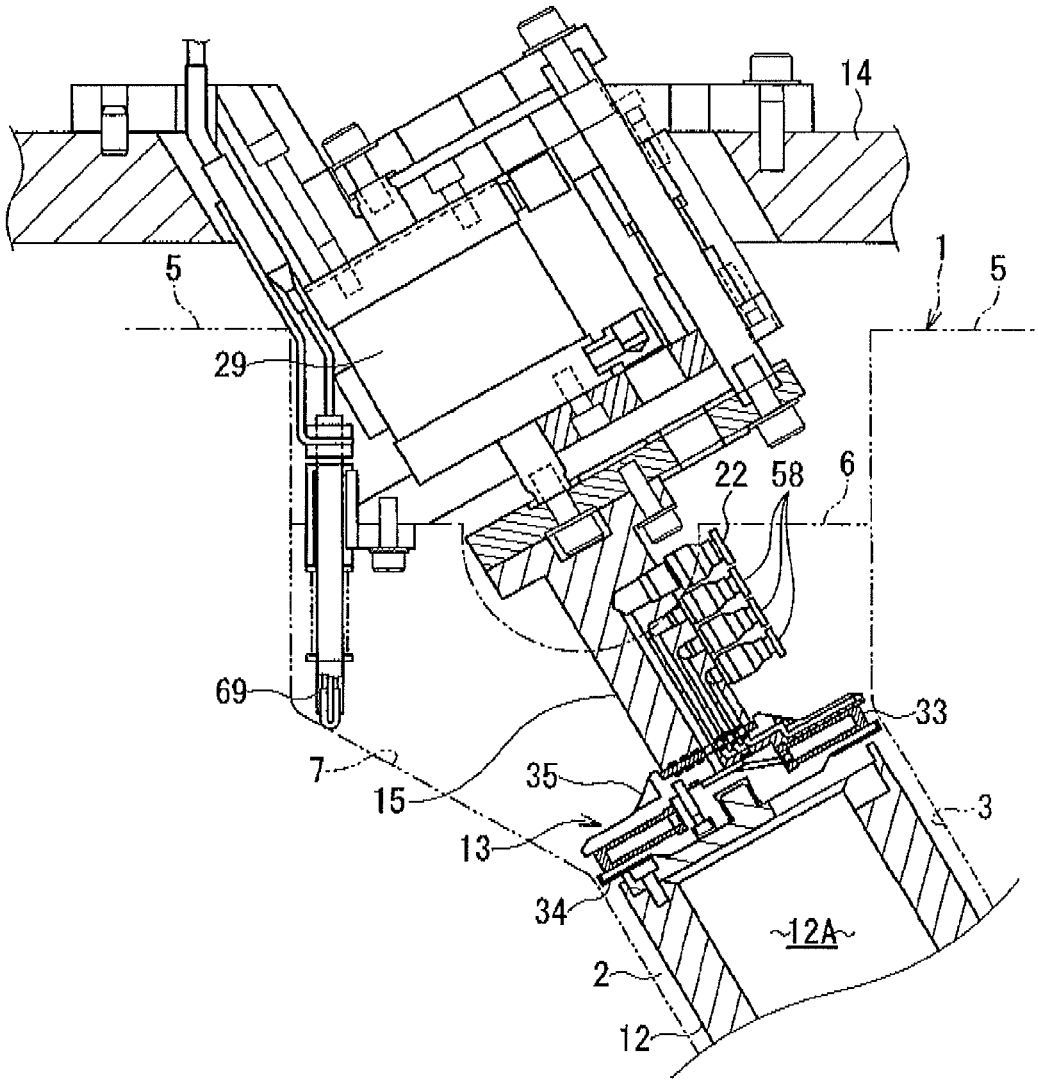
FIG. 6 is a cross-sectional view of the air joint shown in FIG. 4 and the seal jig coupled to each other and an air joint cylinder.

In addition, as shown in FIGS. 5 and 6, in the cylinder block 1, a crank journal 6, which bears a crank shaft (not shown) in cooperation with a crank case (not shown), is disposed close to an end of each cylinder 2 closer to a crank case surface 5 of the cylinder inner wall surface 3. If the pitch of arrangement of the cylinders 2 in the cylinder block 1 is short, the crank journals 6 obstructively project toward the interior of the cylinders 2 in the vicinity of the end of the cylinder inner wall surfaces 3 closer to the crank case surface 5.

As shown in FIG. 3, the apparatus main unit 11 of the treatment apparatus 10 is installed on and fixed to a pedestal 18 and has a workpiece mount 19 on which the cylinder block 1 is mounted. The cylinder block 1 is mounted on the workpiece mount 19 with a head surface 4 facing downward. In the apparatus main unit 11, the workpiece holding jig 14 capable of being lifted and lowered by the clamp cylinder 16 is installed above the workpiece mount 19. The workpiece holding jig 14 has a clamp (not shown). The workpiece holding jig 14 abuts against the crank case surface 5 of the cylinder block 1 mounted on the workpiece mount 19 when the workpiece holding jig 14 is at a lowered position. At this position, the clamp of the workpiece holding jig 14 grips a part of the cylinder block 1 close to the crank case surface 5, and thus, the cylinder block 1 is held between the workpiece mount 19 and the workpiece holding jig 14.

At this point, as shown by the alternate long and two short dashes line in FIG. 3 and in FIG. 5, the air joint 15 is inserted into the cylinder block 1 from the end closer to the crank case surface 5 and kept in a waiting position where the air joint 15 faces the seal jig 13 disposed on the upper end of the electrode 12 at a distance.

The electrode 12 is supported by an electrode supporting section 20, and the electrode supporting section 20 is attached to the electrode cylinder 17 installed in the apparatus main unit 11. When the electrode cylinder 17 moves forward, the electrode 12 is inserted into the cylinder 2 of the cylinder block 1 from the end of the cylinder inner wall surface 3 closer to the head surface 4, and when the electrode cylinder 17 moves backward, the electrode 12 is retracted from the cylinder 2. In FIG. 3, the left-hand electrode 12 is in an inserted position, and the right-hand electrode 12 is in a retracted position. When the electrode 12 is inserted into the cylinder 2 of the cylinder block 1, a seal ring 21 (FIG. 4), such as a silicon rubber sheet, installed on a flow channel block 66 comes into contact with the head surface 4 of the cylinder block 1 to seal the end of the cylinder inner wall surface 3 closer to the head surface 4 (the other end of the cylinder inner wall surface 3).

The flow channel block 66 is integrated with the electrode supporting section 20 and moved with the electrode supporting section 20 and the electrode 12 by the electrode cylinder 17 and forms a flow channel 67 for the treatment liquid in cooperation with the outer surface of the electrode supporting section 20. A flow channel for the treatment liquid is formed also in the electrode 12 (the flow channel is referred to as an in-electrode flow channel).

Referring to FIGS. 3 to 5, the seal jig 13 is disposed on the upper end of the electrode 12, and the air joint 15 serving as a driving mechanism that activates a seal member 33 of the seal jig 13 is mounted on the workpiece holding jig 14, separated from the seal jig 13, and positioned above the seal jig 13 and the electrode 12.

When the electrode cylinder 17 moves forward, the electrode 12 as well as the seal jig 13 is inserted into the cylinder from the end of the cylinder inner wall surface 3 closer to the head surface 4. Thus, there is no need to design the seal jig 13 to avoid collision with the crank journal 6 in FIGS. 5 and 6 in insertion into the cylinder. Therefore, the seal member 33 of the seal jig 13 has an outer diameter close to, or in other words, slightly smaller than the diameter of the cylinder inner wall surface 3, and the amount of expansion or shrinkage of the seal member 33 described later is reduced.

The air joint 15 supplies air, which serves as a working fluid to activate the seal member 33 of the seal jig 13, to the seal member 33. As shown in FIG. 6, the air joint 15 is attached to an air joint cylinder 29 fixed to the workpiece holding jig 14 and can move between a projected position shown in FIGS. 4 and 6 and a waiting position shown by the alternate long and short dash line in FIG. 3 and in FIG. 5 as the air joint cylinder 29 moves forward and backward. Specifically, when the air joint cylinder 29 moves forward, the air joint 15 moves toward the cylinder 2 from the waiting position shown in FIG. 5 and can be coupled to the seal jig 13 inserted in the cylinder 2 as shown in FIGS. 4 and 6.

More specifically, after the electrode 12 is inserted into the cylinder 2 of the cylinder block 1, the air joint 15 abuts against and is coupled to the seal jig 13 when the air joint cylinder 29 moves forward, and air as a working fluid is supplied to the seal member 33 of the seal jig 13 through a main air coupling 22 of the air joint 15 as described in detail later. As a result, the seal member 33 expands only in the radial direction to come into contact with the cylinder inner wall surface 3 of the cylinder block 1, thereby sealing the end (one end) of the cylinder inner wall surface 3 closer to the crank case surface 5. When the supply of air to the seal member 33 is stopped, and the seal member 33 shrinks, the air joint cylinder 29 moves backward to retract the air joint 15 into the waiting position.

As shown in FIGS. 5 and 6, the main air coupling 22 and a sub air coupling 58 described later attached to the air joint 15 are positioned not to collide or interfere with the crank journal 6 of the cylinder block 1.

A treatment liquid pipe 23B is connected to the flow channel block 66 shown in FIGS. 3 and 4 and is provided with a liquid feed pump 24B. In a state where the end of the cylinder inner wall surface 3 of the cylinder block 1 closer to the crank case surface 5 is sealed with the seal jig 13, the liquid feed pump 24B feeds the treatment liquid (plating pretreatment liquid) stored in a chemical tank 25 to a gap flow channel 27 defined by the electrode 12 and the cylinder inner wall surface 3 through the treatment liquid pipe 23B and a flow channel 67 defined by the electrode supporting section 20 and the flow channel block 66 and makes the treatment liquid flow upward through the gap flow channel 27. The treatment liquid having flowed through the gap flow channel 27 then flows through a slit 26 formed between the seal jig 13 and the electrode 12 to reach the in-electrode flow channel 12A, flows downward through the in-electrode flow channel 12A, and then returns to the chemical tank 25 through a treatment liquid pipe 23A (described later).

A treatment liquid pipe 23A is connected to the electrode supporting section 20 and is provided with a liquid feed pump 24A. In a state where the end of the cylinder inner wall surface 3 of the cylinder block 1 closer to the crank case surface 5 is sealed with the seal member 33, the liquid feed pump 24A feeds the treatment liquid (plating solution) stored in the chemical tank 25 to the in-electrode flow channel 12A of the electrode 12 through the treatment liquid pipe 23A and the electrode supporting section 20. The treatment liquid fed to the in-electrode flow channel 12A flows upward through the in-electrode flow channel 12A, through the slit 26 formed between a seal bottom plate 34 (described later) of the seal jig 13 and the electrode 12, downward through the gap flow channel 27 defined by the outer surface of the electrode 12 and the cylinder inner wall surface 3 of the cylinder block 1, and through the flow channel 67 defined by the electrode supporting section 20 and the flow channel block 66, and then returns to the chemical tank 25 through the treatment liquid pipe 23B. The treatment liquid pipes 23A and 23B are bendable flexible hoses.

As shown in FIGS. 3 and 4, a bendable lead 28 is connected to the electrode supporting section 20 and to a power supply device 30. The power supply device 30 supplies electricity to the electrode 12 through the lead 28 and the electrode supporting section 20 when the gap flow channel 27 is filled with the treatment liquid, and the treatment liquid is flowing. In the plating pretreatment of the cylinder inner wall surface 3 of the cylinder block 1, the electrode 12 serves as a negative electrode, and the cylinder block 1 serves as a positive electrode. In the plating treatment of the cylinder inner wall surface 3, electrode 12 serves as a positive electrode, and the cylinder block 1 serves as a negative electrode, thereby forming a plating film on the cylinder inner wall surface 3.

The plating pretreatment performed by the treatment apparatus 10 includes an electrolytic etching and an anodizing. A single type of treatment apparatus 10 can perform both the plating pretreatment and the plating treatment by using different treatment liquids and energization conditions as described later.

Although FIG. 3 shows only one air joint 15, the same number of air joints 15 as the number of electrodes 12 (in other words, the same number of air joints 15 as the number of cylinders 2 in the cylinder block 1) are attached to the workpiece holding jig 14. Reference numeral 31 in FIG. 3 denotes a cleaning shutter used in cleaning of the head surface 4 of the cylinder block 1 by ejection of a cleaning liquid. The cleaning shutter 31 moves forward after the plating pretreatment or the plating treatment of the cylinder inner wall surface 3 of the cylinder block 1 is completed, and the electrode 12 is retracted from the cylinder block 1.

Next, a configuration of the seal jig 13, the air joint 15 and other components will be described with reference to FIGS. 4, 7 and 8.

The seal jig 13 comes into contact with the end of the cylinder inner wall surface 3 closer to the crank case surface 5 and seals the cylinder inner wall surface 3 when the treatment liquid is introduced to the gap flow channel 27 including the cylinder inner wall surface 3 of the cylinder block 1. The seal jig 13 has the seal member 33, the seal bottom plate 34 and a seal base 35.

Figure 7:
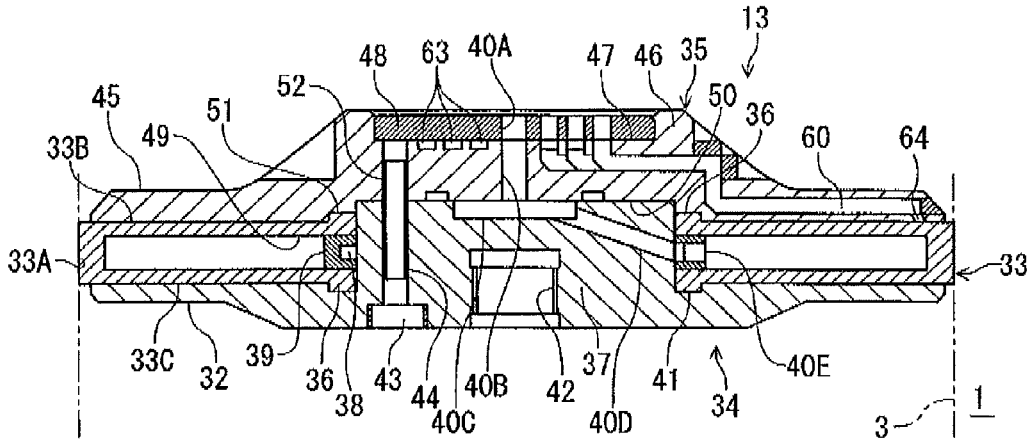
Figure 8:
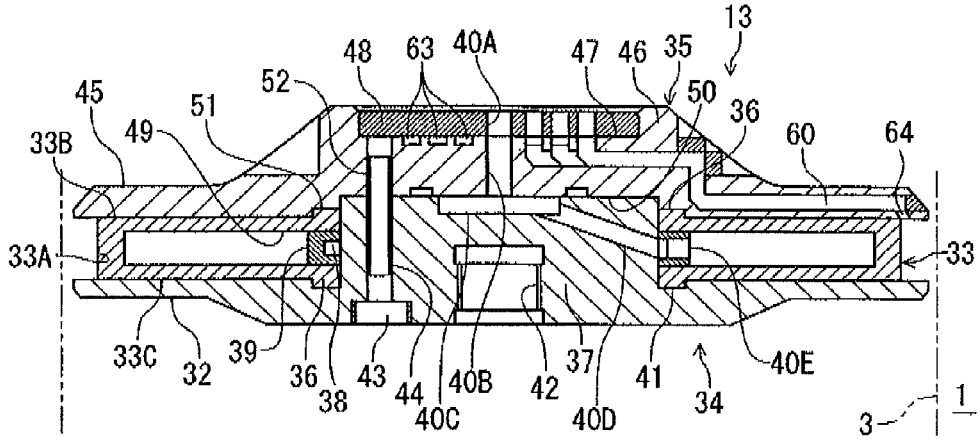

As shown in FIGS. 7 and 8, the seal member 33 is made of a stretchable material (a rubber or other elastic material, for example) and has the shape of a ring buoy. The seal member 33 has a cavity 49 formed in the inner surface thereof and engaging protrusions 36 formed on the opposite sides thereof in the vicinity of the opening of the cavity 49. An outer surface 33A of the seal member 33 can come into contact with the cylinder inner wall surface 3 of the cylinder block 1. The diameter of the outer surface 33A of the seal member 33 is slightly smaller than the diameter of the cylinder inner wall surface 3 when no air is supplied into the seal member 33.

As shown in FIGS. 7 and 8, the seal bottom plate 34 includes a disk-like part 32 and a raised part 37 formed integrally with the disk-like part 32 at the middle of the disk-like part 32. A ring member 39 having a circumferential groove 38 is disposed around the raised part 37. In the raised part 37, main air flow channels 40C and 40D communicating with each other are formed. A plurality of, for example, three, main air flow channels 40D are formed at regular intervals in the circumferential direction of the seal bottom plate 34. The main air flow channels 40D communicate with the circumferential groove 38 of the ring member 39 and with a plurality of (for example, three) main air flow channels 40E that are formed in the ring member 39 at different circumferential positions and communicate with the circumferential groove 38.

In the disk-like part 32 of the seal bottom plate 34, a ring-shaped engaging groove 41 is formed along the boundary with the raised part 37. The engaging protrusion 36 of the seal member 33 is engaged with the engaging groove 41. The disk-like part 32 and the raised part 37 have a female threaded part 42 for fastening and a bolt hole 44 for insertion of a bolt 43. With the ring member 39 being fitted into the cavity 49 of the seal member 33, and the engaging protrusion 36 of the seal member 33 being engaged with the engaging groove 41, the disk-like part 32 of the seal bottom plate 34 configured as described above supports the seal member 33 from one side (the side of a lower surface 33*c* in FIGS. 7 and 8) of the seal member 33.

As shown in FIGS. 7 and 8, the seal base 35 includes a disk-like part 45 and a raised part 46 formed integrally with the disk-like part 45 at the middle of the disk-like part 45. A counterbore 47 and a main air flow channel 40B are formed in the raised part 46. A seal sheet 48 is mounted on the counterbore 47, and a main air flow channel 40A communicating with the main air flow channel 40B is formed in the seal sheet 48. The main air flow channel 408 communicates with the main air flow channel 400 in the seal bottom plate 34.

The disk-like part 45 has a recess 50, into which the raised part 37 of the seal bottom plate 34 can be fitted, on the side opposite to the counterbore 47. The disk-like part 45 further has a ring-shaped engaging groove 51 formed along the outer perimeter of the recess 50. The engaging protrusion 36 of the seal member 33 is engaged with the engaging groove 51. The disk-like part 45 and the raised part 46 have a bolt hole 52 for threaded insertion of the bolt 43.

With the raised part 37 of the seal bottom plate 34 being fitted into the recess 50 of the seal base 35, the ring member 39 of the seal bottom plate 34 being fitted into the cavity 49 of the seal member 33, and the engaging protrusions 36 of the seal member 33 being engaged with the engaging groove 41 of the seal bottom plate 34 and the engaging groove 51 of the seal base 35, the bolt 43 is threaded into the bolt hole 44 of the seal bottom plate 34 and the bolt hole 52 of the seal base 35, thereby integrating the seal member 33, the seal bottom plate 34 and the seal base 35 with each other to form the seal jig 13.

In this state, the seal bottom plate 34 and the seal base 35 are positioned to face each other, the disk-like part 32 of the seal bottom plate 34 supports the seal member 33 from one side thereof (the side of the lower surface 33*c* in FIGS. 7 and 8), and the disk-like part 45 of the seal base 35 supports the seal member 33 from the other side thereof (the side of an upper surface 33B in FIGS. 7 and 8). When the seal member 33, the seal bottom plate 34 and the seal base 35 are integrated with each other, the main air flow channels 40A, 40B, 40C, 40D and 40E communicating with each other communicate with the interior of the seal member 33.

As shown in FIG. 4, the seal jig 13 is attached to the upper end of the electrode 12 with a seal jig attachment plate 53 serving as an insulating member interposed therebetween. The seal jig attachment plate 53 has four notches and thus is substantially cross-shaped. The seal jig attachment plate 53 further has a male threaded part 54 for fastening at the middle thereof. The arms of the substantially cross-shaped seal jig attachment plate 53 are fixed to the electrode 12 with bolts 55. By threading the male threaded part 54 of the seal jig attachment plate 53 into the female threaded part 42 of the seal bottom plate 34 of the seal jig 13, the seal jig 13 composed of the seal member 33, the seal bottom plate 34 and the seal base 35 is attached to the seal jig attachment plate 53.

The seal jig attachment plate 53 is made of a resin or other nonconductive material and insulates the seal bottom plate 34 and the seal base 35 made of a conductive metal from the electrode 12. The treatment liquid flows into the slit 26 through the notches of the substantially cross-shaped seal jig attachment plate 53, as shown by the arrow in FIG. 4. To improve the insulating properties, an insulating collar 68 is attached to the lower surface of the seal jig attachment plate 53 along the outer perimeter thereof.

The air joint 15 shown in FIGS. 3 and 4 has the main air coupling 22 as described above and has a main air supply channel 56 formed therein. The main air coupling 22 is connected to an air supply valve and a compressor (both not shown) via main air supply piping 57. After the electrode 12 is inserted into the cylinder 2 of the cylinder block 1, when the air joint cylinder 29 moves forward, the air joint 15 is inserted into the cylinder 2 from the waiting position shown in FIG. 5, abuts against the seal sheet 48 of the seal jig 13 attached to the electrode 12, and is coupled to the seal jig 13. In this coupled state, the main air supply channel 56 of the air joint 15 communicates with the main air flow channel 40A of the seal sheet 48 of the seal jig 13. The seal sheet 48 prevents leakage of air supplied from the main air supply channel 56 to the main air flow channel 40A.

The seal sheet 48 serves not only to ensure hermeticity to prevent air leakage but also to absorb the impact exerted by the air joint 15 when the air joint 15 abuts against the seal sheet 48. To serve the functions, the seal sheet 48 is preferably made of an elastic material, such as a silicon rubber and a fluoro rubber. The seal sheet 48 may not be mounted on the seal base 35 but provided on the front end of the air joint 15. Alternatively, the seal sheet 48 may be provided both on the seal base 35 of the seal jig 13 and the front end of the air joint 15.

As shown in FIGS. 7 and 8, the air supplied from the main air supply channel 56 to the main air flow channel 40A is guided into the seal member 33 through the main air flow channels 40B, 40C, 40D and 40E. The seal member 33 is supported by the seal base 35 on the side of the upper surface 33B and by the seal bottom plate 34 on the side of the lower surface 33C and is prevented thereby from expanding upward and downward. Thus, as shown in FIG. 7, the seal member 33 expands only in the radial direction, and the outer surface 33A of the seal member 33 comes into contact with the cylinder inner wall surface 3 of the cylinder block 1, thereby sealing the end of the cylinder inner wall surface 3 closer to the crank case surface 5. As a result, the plating pretreatment liquid or the plating solution is prevented from leaking from the gap flow channel 27 (FIG. 4) defined by the cylinder inner wall surface 3 and the outer surface of the electrode 12 into the space on the side of the crank case surface 5.

When air supply into the seal member 33 through the main air coupling 22 is stopped, as shown in FIG. 8, the seal member 33 shrinks in the radial direction, and the outer surface 33A is separated from the cylinder inner wall surface 3. After that, when the air joint cylinder 29 moves backward, the air joint 15 is separated from the seal sheet 48 of the seal jig 13 and returns to the waiting position (FIG. 5).

As shown in FIG. 4, a checking unit that checks the expansion and shrinkage of the seal member 33 is provided on the seal jig 13 and the air joint 15. The checking unit includes a sub air coupling 58 and a sub air supply channel 59 provided on the side of the air joint 15, a sub air flow channel 60 provided on the side of the seal jig 13, an air pressure sensor 61, and a control circuit 62.

A plurality of, for example, three, sub air couplings 58 are attached to the air joint 15. A plurality of, for example, three, sub air supply channels 59 associated and communicating with the sub air couplings 58 are formed in the air joint 15.

As shown in FIGS. 7 and 8, the sub air flow channel 60 is formed in the seal base 35 of the seal jig 13. The seal base 35 has a plurality of (for example, three) concentric ring grooves 63, or more specifically, the same number of concentric ring grooves 63 as the number of the sub air supply channels 59 formed in the top surface of the raised part 46, and each of the ring grooves 63 communicates with a corresponding one of the sub air supply channels 59 (FIG. 4). Furthermore, the seal base 35 has a plurality of (for example, three) sub air flow channels 60, or more specifically, the same number of sub air flow channels 60 as the number of the ring grooves 63 formed radially at regular intervals. Each of the sub air flow channels 60 communicates with a corresponding one of the ring grooves 63. Each sub air flow channel 60 has an air outlet 64 at the outer perimeter of the seal base 35. As shown in FIGS. 7 and 8, the air outlet 64 is formed at a position where the air outlet 64 is closed by the seal member 33 when the seal member 33 expands, and is opened when the seal member 33 shrinks.

The air serving as a working fluid introduced through the sub air couplings 58 on the air joint 15 shown in FIG. 4 flows through the sub air supply channels 59 and through the ring grooves 63 and the sub air flow channels 60 of the seal jig 13 (FIGS. 7 and 8) and is discharged through the air outlets 64. Discharge of the air through the air outlets 64 occurs when the seal member 33 is shrunk, and the air outlets 64 are opened, rather than closed by the seal member 33, as shown in FIG. 8. When the discharge occurs, the air pressure in the sub air flow channels 60, the sub air supply channels 59 and the sub air couplings 58 decreases. To the contrary, when the seal member 33 is expanded, the air outlets 64 are closed by the seal member 33 as shown in FIG. 7, and the air is not discharged through the air outlets 64. Thus, the air pressure in the sub air flow channels 60, the sub air supply channels 59 and the sub air couplings 58 increases.

For example, as shown in FIG. 4, a plurality of, for example, three, pieces of sub air supply piping 65 for introducing the air to the plurality of sub air couplings 58 are each provided with the air pressure sensor 61, and the air pressure sensors 61 detect the air pressure in the sub air flow channels 60 described above. Based on the value of the detected air pressure, it can be checked whether the seal member 33 of the seal jig 13 is expanded or shrunk. That is, it can be checked whether the seal member 33 is expanded and in contact with the cylinder inner wall surface 3 of the cylinder block 1 and liquid-tightly seals the cylinder inner wall surface 3 or the seal member 33 is shrunk and separated from the cylinder inner wall surface 3 of the cylinder block 1 and does not seal the cylinder inner wall surface 3.

Sealing of the cylinder inner wall surface 3 of the cylinder block 1 by expansion of the seal member 33 is checked along the entire periphery of the seal member 33, since a plurality of sub air flow channels 60 are formed at regular intervals along the periphery of the seal base 35 (that is, along the periphery of the seal member 33), for example, three sub air flow channels 60 are formed at 120 degrees along the periphery of the seal member 33. Therefore, when the periphery of the seal member 33 is partially deteriorated, cracks or is damaged and therefore insufficiently expands and fails to come into contact with the cylinder inner wall surface 3 of the cylinder block 1 although the remaining part of the seal member 33 normally expands, sealing of the cylinder inner wall surface 3 can be checked by checking the expansion of the periphery of the seal member 33.

The control circuit 62 shown in FIG. 4 receives the detection value from the air pressure sensor 61 and controls driving of the liquid feed pumps 24A and 24B and the power supply device 30. Specifically, if the detection value from the air pressure sensor 61 is higher than a predetermined value, the control circuit 62 determines that the seal member 33 of the seal jig 13 expands and comes into contact with the cylinder inner wall surface 3 of the cylinder block 1, and the end of the cylinder inner wall surface 3 closer to the crank case surface 5 is adequately sealed. Then, the control circuit 62 activates the liquid feed pump 24A or 24B to supply the treatment liquid to the gap flow channel 27 defined by the cylinder inner wall surface 3 and the outer surface of the electrode 12 and then drives the power supply device 30 to supply power to the electrode 12 to perform the plating pretreatment (electrolytic etching, anodizing) or the plating treatment of the cylinder inner wall surface 3.

If the detection value from the air pressure sensor 61 is equal to or lower than the predetermined value, the control circuit 62 determines that the seal member 33 of the seal jig 13 does not adequately expand or shrinks and fails to come into contact with the cylinder inner wall surface 3, and therefore the cylinder inner wall surface 3 is inadequately sealed. In this case, the control circuit 62 does not drive the liquid feed pumps 24A and 24B and the power supply device 30 or stops any of them in operation.

As shown in FIG. 6, a temperature sensor 69 that measures the temperature of the cylinder block 1 during the plating pretreatment or plating treatment is attached to the workpiece holding jig 14 at a position adjacent to the joint cylinder 29. The temperature sensor 69 measures the temperature of the vicinity of the cylinder inner wall surface 3 of the cylinder block 1, for example, the temperature of a crank case inner surface 7 of the cylinder block 1. The plating pretreatment (the electrolytic etching or the anodizing; in particular, the electrolytic etching) is started when the temperature of the cylinder block 1 measured by the temperature sensor 69 has reached a prescribed temperature for the plating pretreatment.

In other words, the temperature sensor 69 is primarily intended to check whether or not the temperature of the cylinder block 1 is equal to or higher than the prescribed temperature at the start of the electrolytic etching. The prescribed temperature has a margin of 10 degrees C. or preferably 5 degrees C. on the lower temperature side, and the temperature of the cylinder block 1 can be lower than the temperature of the treatment liquid of the plating pretreatment (in particular, the electrolytic etching) by 10 degrees or preferably 5 degrees. More specifically, for example, if the temperature of the treatment liquid of the electrolytic etching is 80 degrees C., the temperature of the cylinder block 1 after preheating (described later) is preferably equal to or higher than 70 degrees C. and more preferably equal to or higher than 75 degrees C. If the temperature of the cylinder block 1 is lower than 70 degrees C., the electrolytic etching cannot be adequately performed at the temperature, and the adhesion of the resulting plating film is low, and thus, a preheating step described later has to be performed again. Although the temperature sensor 69 shown is in contact with the crank case inner surface 7, the point of measurement is preferably as close to the cylinder inner wall surface 3 to be treated as possible.

The temperature sensor 69 is secondarily used to measure the temperature of the cylinder block 1 during the electrolytic etching, the anodizing or the plating treatment. The temperature of the cylinder block 1 may abnormally increase because of heat generation caused by energization. However, the abnormal temperature increase of the cylinder block 1 can be detected by regularly measuring the temperature of the cylinder block 1. However, when the temperature of the cylinder block 1 is measured during energization by the power supply device 30, a nonconductive resin cover is preferably attached to the tip end of the temperature sensor 69 in contact with the crank case inner surface 7 in order to prevent leakage of a current to the temperature sensor 69.

Next, a process of the plating pretreatment and the plating treatment performed on the cylinder inner wall surface 3 of the cylinder block 1 will be described in detail.

The process includes four steps, a degreasing and heating step, an electrolytic etching step, an anodizing step and a plating step.

In the first degreasing and heating step, a degreasing and heating apparatus is used to successively perform a degreasing treatment, a rinsing treatment and a preheating treatment on the cylinder block 1. The degreasing treatment is performed by using an aqueous solution of 20 to 50 g/l of a degreasing agent as a treatment liquid and immersing the whole of the cylinder block 1 in the treatment liquid at a liquid temperature of 40 to 80 degrees C. for a treatment time of 0.5 to 3 minutes. If the cylinder block 1 immersed in the treatment liquid is fluctuated, and an ultrasonic oscillator is used, the degreasing effect can be improved. The degreasing treatment removes oil or other contaminants adhering to the cylinder block 1. The rinsing treatment is performed by using water at room temperature to 80 degrees C. and immersing the whole of the cylinder block 1 in the water for 0.5 to 3 minutes. The preheating treatment is performed by using hot water at 50 to 90 degrees C. and immersing the whole of the cylinder block 1 in the hot water for 0.5 to 3 minutes. The preheating uniformly heats the cylinder block 1 to a prescribed temperature. As a result, in particular, the time required for the electrolytic etching can be reduced, and the uniformity of the etching can be improved.

Then, the treatment apparatus 10 serving as an electrolytic etching apparatus is used to perform an electrolytic etching of the cylinder inner wall surface 3 of the cylinder block 1. For example, specific conditions of the electrolytic etching are that 100 to 500 g/l of phosphoric acid is used as a treatment liquid, that the temperature of the treatment liquid is 60 to 90 degrees C., that the duration of the treatment is 0.5 to 3 minutes, that the flow rate of the treatment liquid is 10 to 50 cm/sec, and that energization is carried out at a current density of 10 to 80 A/dm$^2$. The electrolytic etching removes impurities or oxide films adhering to the cylinder inner wall surface 3 and makes the eutectic silicon in the aluminum alloy project on the surface of the cylinder inner wall surface 3 to make the cylinder inner wall surface 3 coarse. As a result, the adhesion of the plating film is improved by the anchoring effect. After the electrolytic etching, the cylinder block 1 is washed and conveyed to the anodizing step.

Then, in the anodizing step, the treatment apparatus 10 serving as an anodizing apparatus is used to perform an anodizing of the cylinder inner wall surface 3 of the cylinder block 1. For example, specific conditions of the anodizing are that 5 to 70 g/l of phosphoric acid is used as a treatment liquid, that the temperature of the treatment liquid is 30 to 70 degrees C., that the duration of the treatment is 0.5 to 3 minutes, that the flow rate of the treatment liquid is 10 to 50 cm/sec, and that energization is carried out at a current density of 5 to 30 A/dm$^2$. The anodizing forms an oxide film having a thickness of a few microns on the electrolytically etched aluminum surface (the cylinder inner wall surface 3). The oxide film is porous and further improves the adhesion of the plating film by the anchoring effect. After the anodizing, the cylinder block 1 is washed and conveyed to the plating step.

Finally, in the plating step, the treatment apparatus 10 serving as a plating apparatus is used to perform a plating treatment of the cylinder inner wall surface 3 of the cylinder block 1. In the plating apparatus, the electrode serves as a positive electrode, and the cylinder block 1 serves as a negative electrode. The plating apparatus supplies electricity in three steps, first at a low level, then at a medium level, and finally at a high level. 300 to 700 g/l of nickel sulfate is used as a treatment liquid, the temperature of the treatment liquid is 40 to 80 degrees C., the duration of the treatment is 5 to 10 minutes, the flow rate of the treatment liquid is 50 to 80 cm/sec, and energization is carried out first at a current density of 10 to 30 A/dm$^2$ for 0.5 to 1 minute (low level), then at a current density of 30 to 70 A/dm$^2$ for 0.5 to 1 minute (medium level), and finally at a current density of 80 to 120 A/dm$^2$ for 4 to 8 minutes (high level). In this way, a predetermined plating film is formed on the cylinder inner wall surface 3 of the cylinder block 1.

Figure 9:
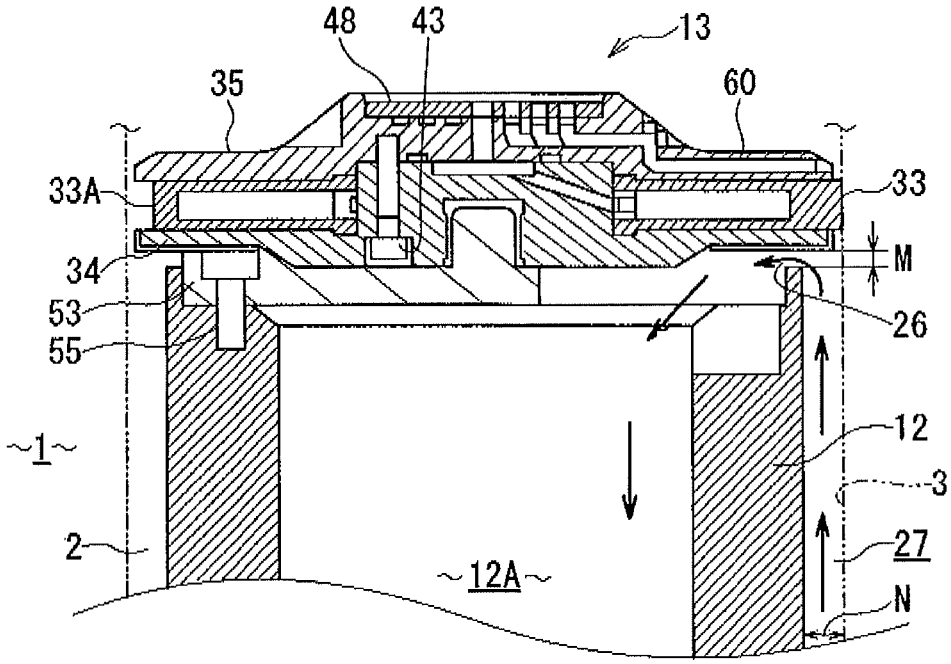
FIG. 9 is an enlarged cross-sectional view of the seal jig shown in FIG. 4 and its vicinity in a state where the seal member of the seal jig is expanded.

In the electrolytic etching and the anodizing described above, as shown by the arrow in FIG. 9 and described above, the treatment liquid flows through the gap flow channel 27 between the cylinder inner wall surface 3 and the electrode 12 vertically toward the seal jig 13 from bottom (closer to the head surface 4) to top (closer to the crank case surface 5) and then flows into the in-electrode flow channel 12A via the slit 26. The slit 26 is a communicating hole formed between the seal bottom plate 34 of the seal jig 13 and the front end of the electrode 12 to communicate the gap flow channel 27 and the in-electrode flow channel 12A with each other. The slit 26 is formed in the gap flow channel 27 at the uppermost position closest to the seal jig 13.

Since the treatment liquid flows from the gap flow channel 27 into the in-electrode flow channel 12A via the slit 26, the gap flow channel 27 is reliably filled with the treatment liquid without forming a bubble. In addition, since the slit 26 is formed at the uppermost position of the gap flow channel 27, reaction gas produced in the gap flow channel 27 in the plating pretreatment can be discharged into the in-electrode flow channel 12A through the slit 26.

The width M of the slit 26 that determines the flow channel cross-sectional area of the slit 26 is smaller than the width N of the gap flow channel 27 that determines the flow channel cross-sectional area of the gap flow channel 27. As a result, the pressure of the treatment liquid flowing in the gap flow channel 27 increases, so that the reaction gas produced in the gap flow channel 27 is efficiently pushed into the in-electrode flow channel 12A through the slit 26 and discharged. Specifically, the width N of the gap flow channel 27 is 5 to 10 mm, and the width M of the slit 26 is 2 to 4 mm.

Furthermore, the flow rate of the treatment liquid flowing through the gap flow channel 27, the slit 26 and the in-electrode flow channel 12A is equal to or higher than 10 cm/sec, or preferably, equal to or higher than 20 cm/sec. If the flow rate of the treatment liquid is set as described above, the reaction gas produced in the gap flow channel 27 in the plating pretreatment (the electrolytic etching or the anodizing) can be discharged into the in-electrode flow channel 12A along with the flow of the treatment liquid.

Figure 10:
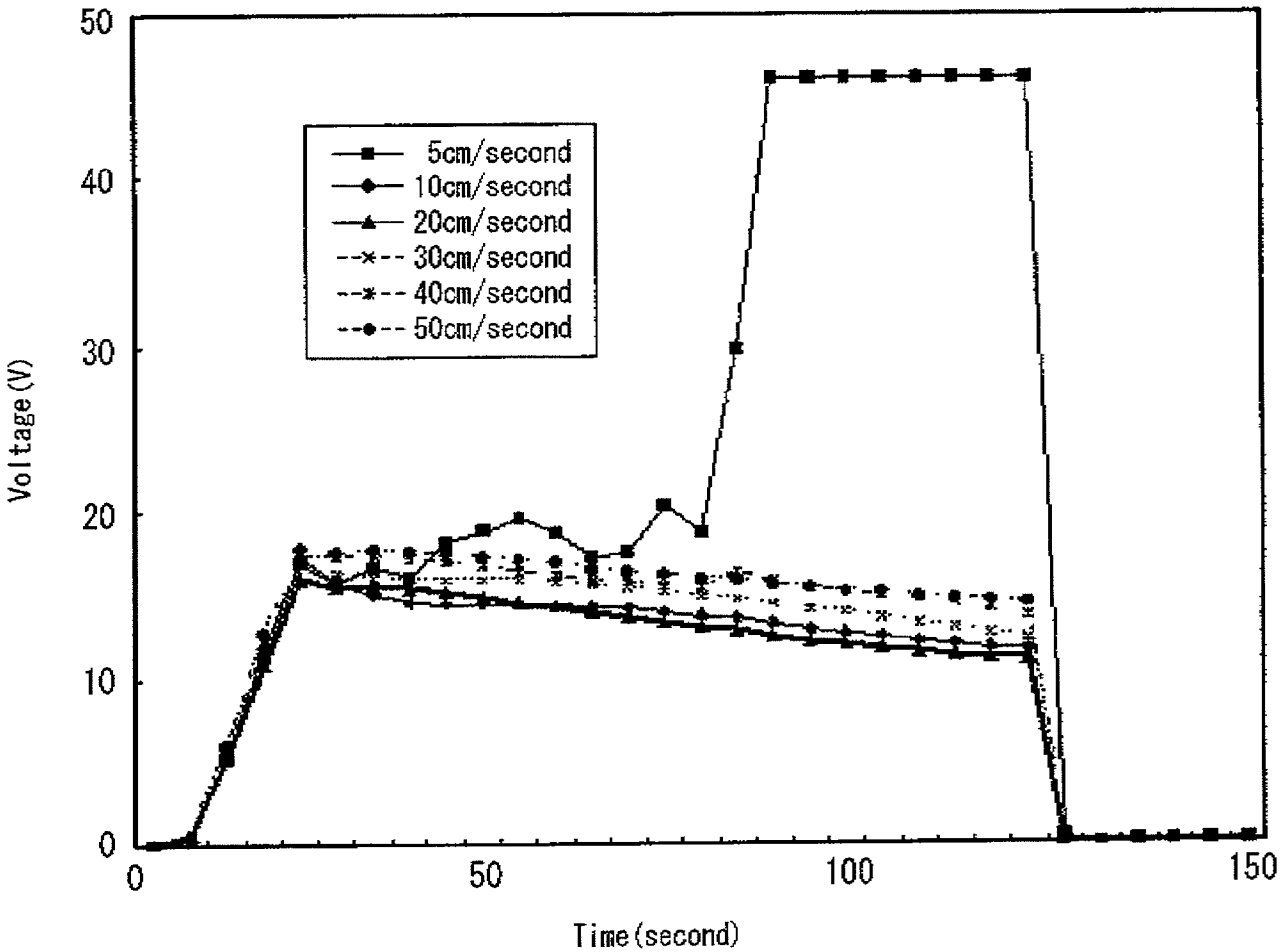
FIG. 10 is a graph showing transitions of the voltage in an electrolytic etching for different flow rates of a treatment liquid.
Figure 12:
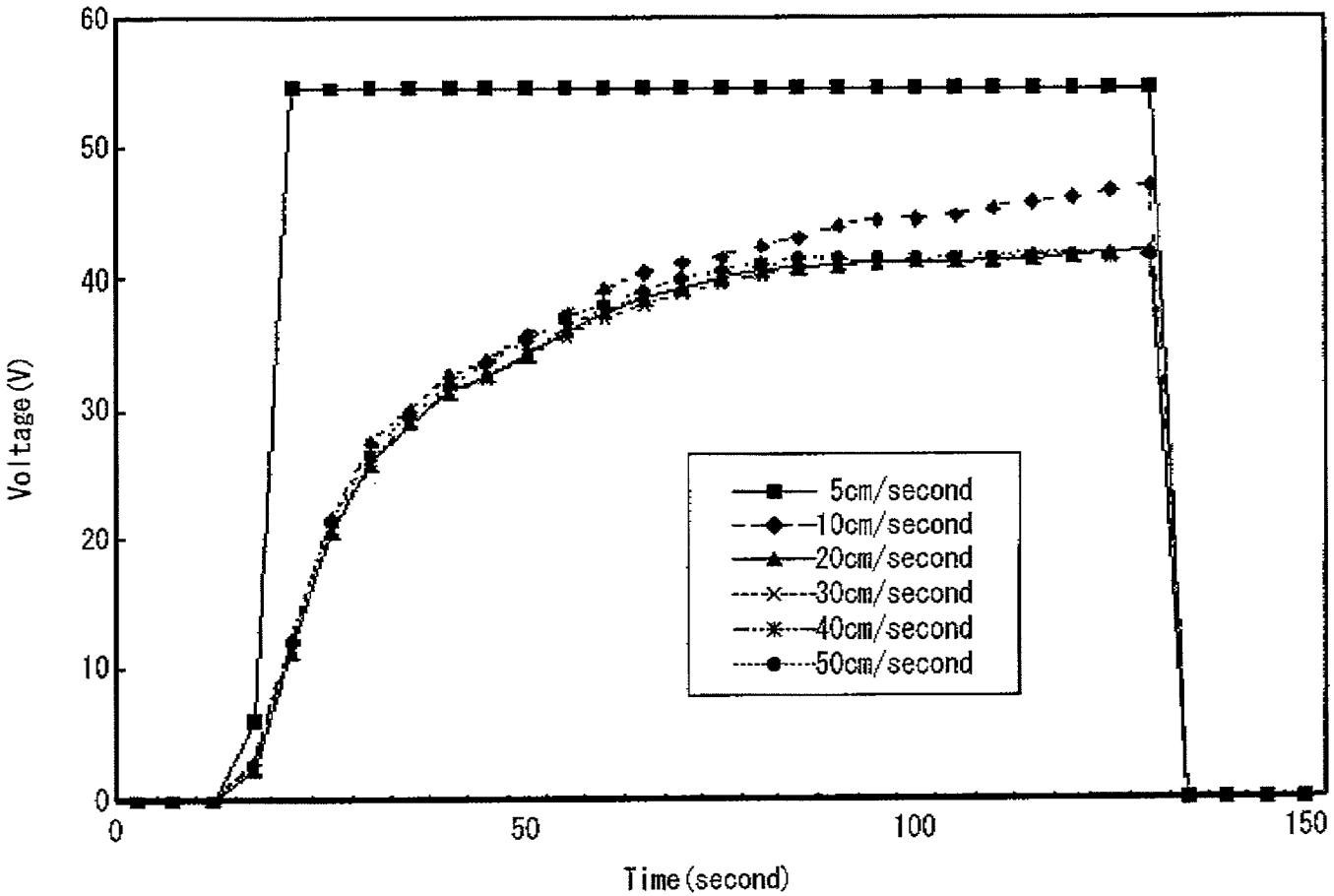
FIG. 12 is a graph showing transitions of the voltage in an anodizing for different flow rates of the treatment liquid.

FIGS. 10 to 12 show specific examples.

FIG. 10 shows transitions of the voltage in the electrolytic etching in the cases where the current is fixed at 200 A, and the flow rate of the treatment liquid is varied in a range from 5 to 50 cm/sec. When the flow rate of the treatment liquid is 5 cm/sec, the voltage rapidly increases in the course of the treatment, which shows that the reaction gas is not discharged from but accumulated in the gap flow channel 27, and the treatment is not adequately performed. FIG. 11 shows the adhesion of the plating film at a position on the cylinder inner wall surface 3 close to the crank case surface 5, a position close to the head surface 4 and an intermediate position thereof in the cases where the electrolytic etching is performed under the conditions described above. When the flow rate of the treatment liquid is 5 cm/sec, the adhesion is considerably low at the position close to the crank case surface 5, which shows that the inadequate etching due to accumulation of the reaction gas in the gap flow channel 27 affects the adhesion. The problem of inadequate adhesion is solved by increasing the flow rate of the treatment liquid, and an adequate adhesion is provided over the entire cylinder inner wall surface 3 when the flow rate is 20 cm/sec or higher.

FIG. 12 shows transitions of the voltage in the anodizing in the cases where the current is fixed at 50 A, and the flow rate of the treatment liquid is varied. When the flow rate of the treatment liquid is 5 cm/sec, the voltage rapidly increases from the beginning of the treatment, which shows that the reaction gas is accumulated in the gap flow channel 27 from the beginning of the treatment, and the treatment is not adequately performed. When the flow rate of the treatment liquid is 10 cm/sec, the voltage starts gradually increasing in the course of the treatment, which can be considered as a result of accumulation of the reaction gas in the gap flow channel 27. However, for the case where the flow rate of the treatment liquid is 10 cm/sec, the anodizing is not necessarily considered failed.

As can be seen from the above description, in the plating pretreatment (the electrolytic etching, the anodizing), the flow rate of the treatment liquid is preferably equal to or higher than 10 cm/sec, or more preferably, equal to or higher than 20 cm/sec.

Configured as described above, this embodiment has the following advantages (1) to (5).

(1) Since the plating pretreatment of the cylinder inner wall surface 3 of the cylinder block 1 is performed with the end of the cylinder inner wall surface closer to the crank case surface 5 sealed with the seal jig 13, the seal jig 13 prevents the reaction gas produced in the plating pretreatment from being discharged to the work environment and the treatment liquid from flowing to the other part than the cylinder inner wall surface 3.

Even if the reaction gas is a toxic gas, since the reaction gas is prevented from being discharged to the work environment, the equipment including the treatment apparatus 10 that performs the plating pretreatment is protected from corrosion, and the operators are kept safe.

In addition, since the treatment liquid is prevented from flowing to the other part of the cylinder block 1 than the cylinder inner wall surface 3, corrosion or contamination of the other part than the cylinder inner wall surface 3 to be plated is prevented, and the amount (usage) of the treatment liquid is minimized.

(2) Since the treatment liquid flowing through the gap flow channel 27 between the cylinder inner wall surface 3 of the cylinder block 1 and the electrode 12 toward the seal jig 13 flows into the in-electrode flow channel 12A through the slit 26 formed in the gap flow channel 27 at the uppermost position closest to the seal jig 13, the reaction gas produced in the gap flow channel 27 is discharged into the in-electrode flow channel 12A. As a result, accumulation of the reaction gas in the gap flow channel 27 is prevented, and problems, such as inadequate energization and inadequate filling of the gap flow channel 27 with the treatment liquid, are avoided, so that the plating pretreatment of the entire cylinder inner wall surface 3 is adequately performed.

(3) Since the flow channel cross-sectional area of the slit 26 (the width M, for example) is smaller than the flow channel cross-sectional area of the gap flow channel 27 (the width N, for example), the pressure of the treatment liquid flowing in the gap flow channel 27 increases. As a result, the reaction gas produced in the gap flow channel 27 is efficiently pushed into the in-electrode flow channel 12A through the slit 26 and discharged. As a result, accumulation of the reaction gas in the gap flow channel 27 is prevented, and problems, such as inadequate energization, are avoided, so that the plating pretreatment of the entire cylinder inner wall surface 3 is adequately performed.

(4) Since the flow rate of the treatment liquid flowing through the gap flow channel 27, the slit 26 and the in-electrode flow channel 12A is equal to or higher than 10 cm/sec (preferably equal to or higher than 20 cm/sec), the reaction gas produced in the gap flow channel 27 in the plating pretreatment is discharged into the in-electrode flow channel 12A along with the flow of the treatment liquid. As a result, accumulation of the reaction gas in the gap flow channel 27 is reliably prevented, and problems, such as inadequate energization, are avoided, so that the plating pretreatment of the entire cylinder inner wall surface 3 is adequately performed.

(5) Since the temperature sensor 69 measures the temperature of the cylinder block 1 at a position close to the cylinder inner wall surface 3 (the temperature of the crank case inner surface 7, for example) in the plating pretreatment (in particular, the electrolytic etching), and the plating pretreatment is started only if the temperature of the cylinder block 1 has reached a prescribed temperature for the plating pretreatment, the plating pretreatment provides an adequate adhesion of the plating film. In addition, since the temperature sensor 69 measures the temperature of the cylinder block 1 in the plating pretreatment and the plating treatment, an abnormal temperature increase of the cylinder block 1 during the treatment is detected and addressed, so that the safety is improved.

What is claimed is:

1. An apparatus for plating pretreatment of a cylinder block, comprising:

a seal jig sealing one end of a cylinder inner wall surface of a cylinder in the cylinder block; and an electrode performing a plating pretreatment of the cylinder inner wall surface, wherein the seal jig is disposed to one end of the electrode through a female thread part, a seal jig attachment plate and bolts for fastening, wherein the seal jig is disposed at an upper end portion of the electrode, the electrode disposed to face the cylinder inner wall surface, the electrode forming a gap flow channel between the cylinder inner wall surface and the outer surface of the electrode, the electrode having an in-electrode flow channel formed therein, wherein the gap flow channel communicates with the in-electrode flow channel via a communicating hole formed in the gap flow channel and by a lower surface of the seal jig and the upper end portion of the electrode at a position closest to the seal jig and an upper end portion of the gap flow channel, the gap flow channel being adapted to introduce a treatment liquid to the cylinder inner wall surface and flow the treatment liquid therethrough toward the seal jig, and the in-electrode flow channel is adapted to receive and flow therethrough the treatment liquid having passed through the communicating hole, and wherein the flow channel cross-sectional area of the communicating hole is smaller than the flow channel cross-sectional area of the gap flow channel.

2. The plating pretreatment apparatus for a cylinder block according to claim 1, wherein the flow rate of the treatment liquid flowing through the gap flow channel and the in-electrode flow channel is equal to or higher than 10 cm/second.

3. The plating pretreatment apparatus for a cylinder block according to claim 1, further comprising a temperature sensor that measures the temperature of the cylinder block at a position close to the cylinder inner wall surface in the plating pretreatment.

4. A method for before plating a cylinder block, the method comprising:

preparing a seal jig sealing one end of a cylinder inner wall surface of a cylinder in the cylinder block and an electrode performing a plating pretreatment of the cylinder inner wall surface, the seal jig being disposed to one end of the electrode through a female thread part, a seal jig attachment plate and bolts for fastening;

sealing one end of a cylinder inner wall surface of a cylinder in the cylinder block;

disposing an electrode to face the cylinder inner wall surface so as to form a gap flow channel between the cylinder inner wall surface and the outer surface of the electrode, the electrode having an in-electrode flow channel formed therein, the gap flow channel communicating with the in-electrode flow channel via a communicating hole formed in the gap flow channel at a position closest to the seal jig; and introducing a treatment liquid to the gap flow channel thereby flowing through the treatment liquid toward the seal jig and then into the in-electrode flow channel through the communicating hole, wherein the flow channel cross-sectional area of the communicating hole is smaller than the flow channel cross-sectional area of the gap flow channel, and a flow rate of the treatment liquid flowing through the gap flow channel and the in-electrode flow channel is 10 to 50 cm/second.

5. The method according to claim 4, wherein the temperature of the cylinder block is measured at a position in proximity to the cylinder inner wall surface, and when the temperature of the cylinder block has reached a prescribed temperature, the pretreatment is started.

* * * * *